US007617625B2

(12) United States Patent
Storm

(10) Patent No.: US 7,617,625 B2
(45) Date of Patent: Nov. 17, 2009

(54) DEVICE FOR DISPLAYING INFORMATION

(75) Inventor: Jan Storm, Soest (NL)

(73) Assignee: Polytrust Partners B.V., HC Soest (NL)

( * ) Notice: Subject to any disclaimer, the term of this patent is extended or adjusted under 35 U.S.C. 154(b) by 956 days.

(21) Appl. No.: 10/296,278

(22) PCT Filed: May 23, 2001

(86) PCT No.: PCT/NL01/00398

§ 371 (c)(1),
(2), (4) Date: Jul. 28, 2003

(87) PCT Pub. No.: WO01/91089

PCT Pub. Date: Nov. 29, 2001

(65) Prior Publication Data

US 2004/0025391 A1 Feb. 12, 2004

(30) Foreign Application Priority Data

May 23, 2000 (NL) ..... 1015279

(51) Int. Cl.
*G09F 21/04* (2006.01)

(52) U.S. Cl. ..... 40/590; 40/514; 296/180.2

(58) Field of Classification Search ..... 40/514, 40/515, 590, 471, 591; 160/45, 55, 66; 296/21, 296/142, 180.2, 180.4, 97.7, 97.9; 280/403
See application file for complete search history.

(56) References Cited

U.S. PATENT DOCUMENTS

| | | | | | |
|---|---|---|---|---|---|
| 1,284,828 | A | * | 11/1918 | Walby | 40/514 |
| 1,749,784 | A | * | 3/1930 | Slotsky | 40/471 |
| 3,334,432 | A | * | 8/1967 | Bates et. al. | 40/471 |
| 3,430,374 | A | * | 3/1969 | Woodard | 40/591 |
| 3,711,146 | A | * | 1/1973 | Madzsar et al. | 296/180.2 |
| 4,343,505 | A | * | 8/1982 | Levassor | 296/180.2 |
| 4,518,188 | A | * | 5/1985 | Witten | 296/180.2 |
| 6,427,709 | B1 | * | 8/2002 | Montes | 135/88.07 |

FOREIGN PATENT DOCUMENTS

| | | | | |
|---|---|---|---|---|
| DE | 468 329 | C | | 11/1928 |
| DE | 198 51 720 | A | | 5/1999 |
| FR | 1 051 852 | A | | 1/1954 |
| FR | 2 526 569 | A | | 11/1983 |
| GB | 2245403 | A | * | 1/1992 |
| NL | 9 500 525 | A | | 11/1996 |

* cited by examiner

*Primary Examiner*—Joanne Silbermann
(74) *Attorney, Agent, or Firm*—The Webb Law Firm

(57) ABSTRACT

A device for displaying information, such as an advertisement, on a lorry comprises a web of a material in sheet or canvas form, a reel which can be attached to the lorry, onto which the web can be wound up and from which the web can be unwound, and attachment means for attaching the unwound web to the lorry, which web, in the unwound state, defines an image surface with a height direction and a width direction, on which image surface the information can be placed. The height direction of the image surface is parallel to the reel.

2 Claims, 2 Drawing Sheets

DEVICE FOR DISPLAYING INFORMATION

The invention relates to a device for displaying information, such as an advertisement, on a lorry, comprising a web of a material in sheet or canvas form, a reel which can be attached to the lorry, onto which the web can be wound up and from which the web can be unwound, and attachment means for attaching the unwound web to the lorry, which web, in the unwound state, defines an image surface with a height direction and a width direction, on which image surface the information can be placed.

A device of this type is known from NL-A-9500525. This known device, which is located on the side wall of a lorry, has a horizontally positioned reel onto which a canvas is wound. The reel is mounted in the vicinity of the top side of the side wall, in such a manner that the canvas can be unwound downwards. An advertisement is visible on the unwound canvas.

The side walls of a lorry inherently form a sizeable area for advertisements. Moreover, an advertisement which is arranged on a lorry attracts a relatively large amount of attention, while its distribution range is substantial. However, the known device has the drawback that its possible applications are relatively limited. For example, the dimensions are only suitable for a certain type of lorry. For lorries with different dimensions, the dimensions of the canvas and the reel have to be adapted.

Therefore, it is an object of the invention to provide a device of the abovementioned type which can be used more flexibly. This object is achieved by the fact that the height direction of the image surface is parallel to the reel.

In the device according to the invention, the web of material in sheet form is unwound in the horizontal direction along the side wall of the lorry, for example from the front towards the rear. Consequently, the device can be very successfully used for all kinds of lorries of different lengths.

Moreover, the device according to the invention also offers other possibilities which do not exist with the known device described above. For example, the device according to the invention can be used not only on a lorry with a fixed loading space but also on a lorry cab with a trailer. In that case, the reel may be mounted on the lorry cab, in such a manner that the unwound canvas extends along the trailer and is also attached thereto.

The information situated on the web may then be in all kinds of forms. For example, the information may comprise at least one series of readable characters, which series extends parallel to the width direction of the image surface.

Furthermore, the information may comprise a picture, in which case the bottom edge and the top edge of the picture extend parallel to the width direction of the image surface.

The invention also comprises an assembly comprising a lorry and at least one device for displaying information, such as an advertisement, which device comprises a web of a material in sheet or canvas form, a reel, which is attached to the lorry for winding up and unwinding the web, and attachment means for attaching the unwound web to the lorry.

An assembly of this type with a horizontally oriented reel is also known from NL-A-9500525. According to the invention, however, the reel is oriented vertically instead of horizontally.

In particular, in this case it is possible to use a lorry which comprises a lorry cab and a trailer, in which case the reel is attached to the cab and the attachment means of the web can engage on the trailer.

An advantage of this variant is that the lorry cab may be (semi-)permanently provided with a web bearing a specific advertisement. The trailer, in particular used for transporting seaborne containers, in that case does not have to be adapted in any way. The device according to the invention can consequently be used universally and flexibly irrespective of the type of freight on the trailer.

If appropriate, the trailer may, in the vicinity of at least one of its front vertical corners, bear a guide for guiding the web which extends along it. The guide ensures that the web is not damaged by the edges of the container when cornering.

The invention will now be explained in more detail with reference to an exemplary embodiment illustrated in the figures, in which.

Figure 1:
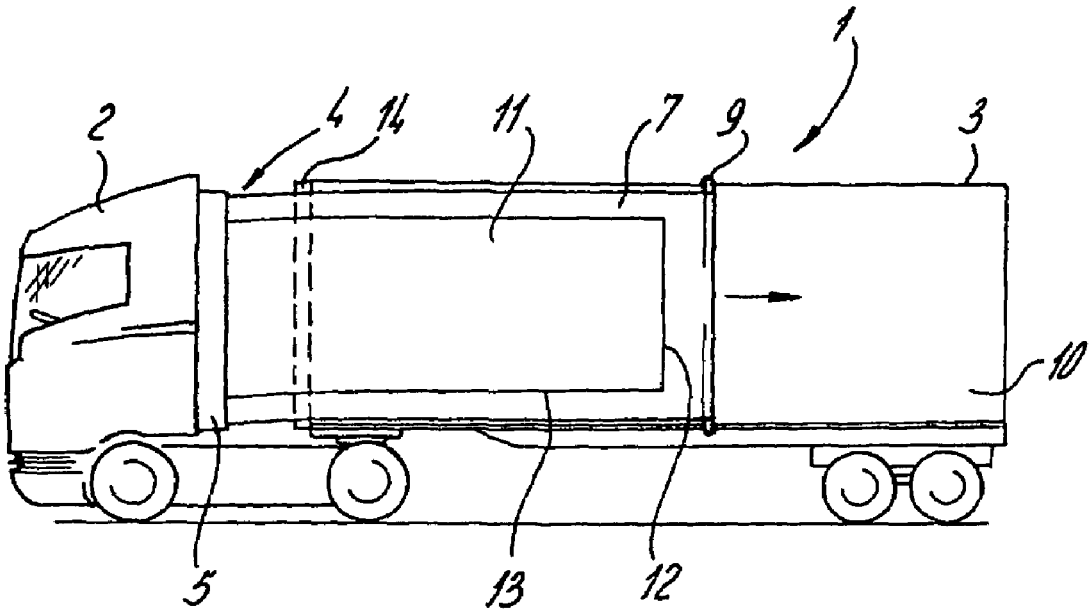
FIG. 1 shows an assembly comprising a device according to the invention, and a lorry.
Figure 3:
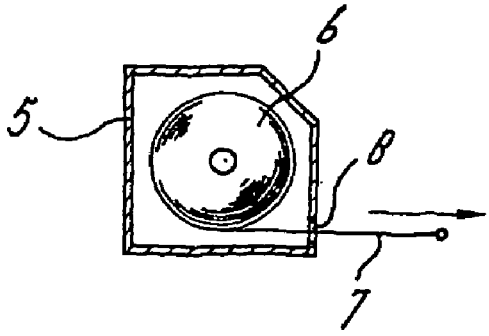
FIG. 3 shows a cross section through the device according to the invention.

The lorry 1 illustrated in FIG. 1 comprises a lorry cab 2 and a trailer 3. A device according to the invention, which is denoted overall by 4, is fitted to the lorry 1. This device 4 comprises a holder 5 in which there is a reel 6 onto which a web of material 7 is partially wound up; cf. also the cross section shown in FIG. 3. The web of material 7 can be pulled outwards via the opening 8 in the holder 5.

As shown in FIG. 1, the web of material 7 has already been pulled partially outwards. Depending on its length, the web of material 7 can be pulled out all the way to the rear of the trailer 3, where it can be fixed using the attachment means 9 which may, for example, comprise a bar which is fixed to the side wall 10 of the trailer 3 at its top and bottom ends.

In the completely unwound state, the image surface 11 on the web of material 7 is visible. This image surface 11 comprises relatively short sides 12 which run in the height direction and relatively long sides 13 which run in the width direction.

Any desired information, for example a written advertisement, a picture, etc., can be applied to the image surface 11.

Figure 2:
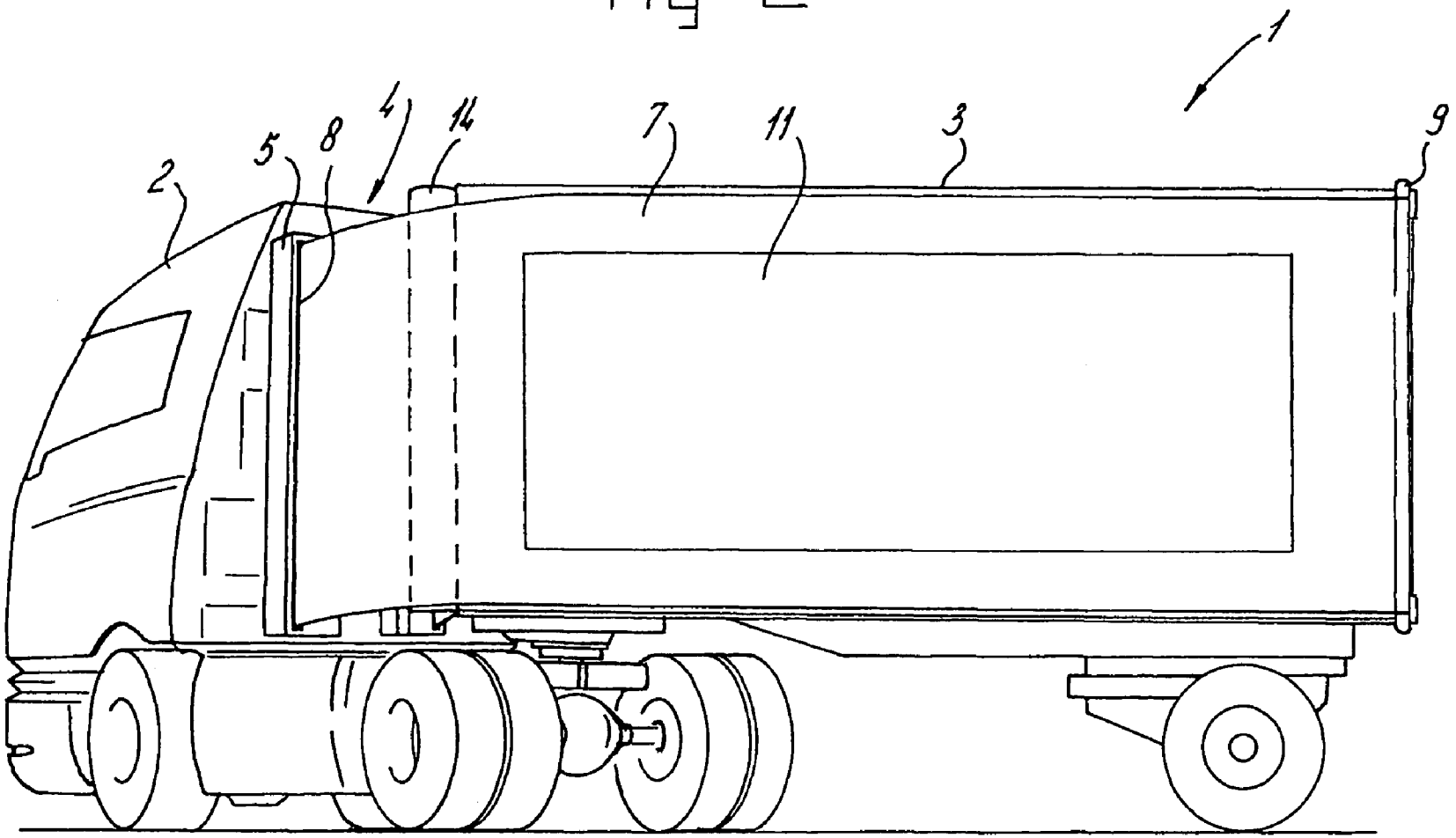
FIG. 2 shows a second side view.

As shown in FIG. 2, a guide strip 14 may be arranged on the front vertical corners of the trailer 3, in such a manner that the web of material 7 can be guided past these front corners of the trailer 3 without being damaged even when cornering.

The invention claimed is:

1. An assembly comprising a lorry and at least one device for displaying information, which device comprises:

a web of a material in sheet or canvas form;

a reel which is attached to the outside of the lorry with a longitudinal axis of the reel oriented substantially vertically, the reel for winding up and unwinding the web; and attachment means for attaching the unwound web to the lorry, wherein:

the lorry comprises a lorry cab and a trailer; and the reel is attached to the lorry cab and the attachment means is arranged to engage the trailer.

2. The assembly according to claim 1, wherein the trailer, in the vicinity of at least one of its front vertical corners, bears a guide for guiding the web which extends along it.

* * * * *

UNITED STATES PATENT AND TRADEMARK OFFICE

CERTIFICATE OF CORRECTION

PATENT NO. : 7,617,625 B2
APPLICATION NO. : 10/296278
DATED : November 17, 2009
INVENTOR(S) : Jan Storm It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 913 days.

Signed and Sealed this

Nineteenth Day of October, 2010

David J. Kappos

David J. Kappos
*Director of the United States Patent and Trademark Office*